US007272355B2

(12) United States Patent
Suzuki et al.

(10) Patent No.: US 7,272,355 B2
(45) Date of Patent: Sep. 18, 2007

(54) CLEANING DEVICE FOR IMAGE FORMING APPARATUS

(75) Inventors: Takashi Suzuki, Hitachinaka (JP); Kenji Nakamura, Hitachinaka (JP); Hirobumi Ooyoshi, Hitachinaka (JP); Yoshitaka Fujinuma, Hitachinaka (JP); Masato Miwa, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 151 days.

(21) Appl. No.: 11/193,628

(22) Filed: Aug. 1, 2005

(65) Prior Publication Data

US 2006/0024099 A1 Feb. 2, 2006

(30) Foreign Application Priority Data

Aug. 2, 2004 (JP) ..... P2004-225088

(51) Int. Cl.
*G03G 21/00* (2006.01)

(52) U.S. Cl. ..... 399/349; 399/350

(58) Field of Classification Search ..... 399/349, 399/350, 353, 343; 15/256.5, 256.51, 256.52; 430/125

See application file for complete search history.

(56) References Cited

U.S. PATENT DOCUMENTS 4,427,289 A * 1/1984 Oda ..... 399/350 X
5,715,513 A * 2/1998 Ohta et al. ..... 399/353
2001/0051312 A1* 12/2001 Itami et al. ..... 430/125
2003/0049557 A1* 3/2003 Itami et al. ..... 430/125
2003/0053831 A1* 3/2003 Maeshima et al. ..... 399/349
2004/0072093 A1* 4/2004 Itami ..... 430/125
2004/0202495 A1* 10/2004 Koike et al. ..... 399/349 X

FOREIGN PATENT DOCUMENTS

JP 2001-109212 4/2001
JP 2002-156879 5/2002
JP 2004-101816 A * 4/2004

* cited by examiner

*Primary Examiner*—Sophia S. Chen
(74) *Attorney, Agent, or Firm*—Whitham Curtis Christofferson & Cook, PC

(57) ABSTRACT

A cleaning device is disposed substantially vertical above a photosensitive drum for the purpose of constructing a compact electrophotographic printer. The cleaning device includes a housing that accommodates an auxiliary toner conveying part and a sheet-like resilient member. A cleaning brush is also disposed in the housing so that a gap of 1-3 mm is formed between the cleaning brush and the auxiliary toner conveying part and resilient member. During an image forming operation, toner accumulates between the cleaning blade and the cleaning brush and is conveyed upward through the gap between the cleaning brush and the auxiliary toner conveying part and resilient member. The toner drops onto the cleaning brush near the top thereof and is conveyed by the cleaning brush to a screw. The screw discharges the toner from the cleaning device.

11 Claims, 5 Drawing Sheets

CLEANING DEVICE FOR IMAGE FORMING APPARATUS

BACKGROUND OF THE INVENTION

1. Field of the Invention

The present invention relates to a cleaning device for an image forming apparatus, and particularly to a cleaning device for removing residual toner from an image-carrying member using a cleaning blade.

2. Description of the Related Art

Conventional electrophotographic printers, such as image forming apparatus, have been provided with a photosensitive drum, an intermediate transfer member, and a cleaning device for cleaning the surface of the photosensitive drum. In such devices, electrostatic latent images are formed on the photosensitive drum and developed into toner images by a developer formed of toner. The toner image is then transferred from the photosensitive drum to the intermediate transfer member.

FIG. 1 shows an example of a cleaning device 140 provided in opposition to a photosensitive drum 131. The cleaning device 140 includes a housing 141, a cleaning brush 142, and a cleaning blade 143. An opening 141*a* is formed in the housing 141 opposite the photosensitive drum 131 for allowing communication between the inside and outside of the housing 141. The opening 141*a* is formed approximately in one side of the housing 141. The cleaning brush 142 and cleaning blade 143 are disposed in the opening 141*a* of the housing 141. The cleaning device 140 also includes a substantially cylindrical screw 144 disposed opposite the cleaning brush 142.

The cleaning blade 143 is disposed in contact with the photosensitive drum 131 with pressure. The cleaning brush 142 has a substantially cylindrical shape and is disposed upstream of the cleaning blade 143 with respect to the rotational direction of the photosensitive drum 131. The cleaning brush 142 opposes and contacts the photosensitive drum and rotates counterclockwise when the photosensitive drum 131 rotates in the clockwise direction. The cleaning blade 143 and cleaning brush 142 remove toner remaining on the photosensitive drum 131 after the toner image has been transferred to the intermediate transfer member. The cleaning brush 142 conveys toner that has been removed from the surface of the photosensitive drum 131 by the cleaning blade 143 toward the screw 144.

The cleaning device 140 having this construction prevents toner that has been removed from the photosensitive drum 131 from falling out of the opening 141*a* in the housing 141 and scattering.

As color electrophotographic printers have become more popular in recent years, it has become necessary to accommodate a plurality of image-forming units in a compact electrophotographic printer. To achieve this, the cleaning devices are disposed at positions directly above the respective photosensitive drum; the cleaning blades are placed in contact with the photosensitive drums near the top of the same; and the openings in the housings are formed in the bottoms thereof.

In this case, it is necessary to provide an auxiliary member for the cleaning device to prevent toner from leaking and scattering. For example, an air suction device may be provided for drawing air from the inside of the cleaning device. In Japanese patent application publications Nos. 2001-109212 and 2002-156879, an elastic plate is provided on the downstream end of the cleaning blade with respect to the rotational direction of the photosensitive drum and is held in contact with the photosensitive drum.

However, the actual process of discharging toner recovered by the cleaning blade is difficult to achieve by providing an air suction device or an elastic plate on the end of the cleaning blade for contacting the photosensitive drum. Further, if the inside of the electrophotographic printer becomes dirty by scattered or leaked toner or if toner clogs the cleaning device, frequent maintenance is necessary.

SUMMARY

In view of the foregoing, it is an object of the present invention to provide an image forming apparatus that is capable of preventing toner from leaking, even when the cleaning device is disposed above the photosensitive drum or image-carrying member.

To achieve the above and other objects, the present invention provides an image forming apparatus that includes an image-carrying member, a cleaning blade, a cleaning brush, and a housing.

The image-carrying member is rotatable in a direction about a rotational axis. The cleaning blade has a peripheral surface and is disposed in contact with an image-carrying member. The cleaning brush is disposed in contact with the image-carrying member at a position upstream of the cleaning blade with respect to the rotational direction of the image-carrying member. The housing is disposed substantially vertically above the image-carrying member for accommodating the cleaning blade and the cleaning brush, and has a toner flow path for leading toner from the cleaning blade to a position substantially vertically above the cleaning brush substantially along the peripheral surface of the cleaning brush.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE PREFERRED EMBODIMENTS

Figure 1:
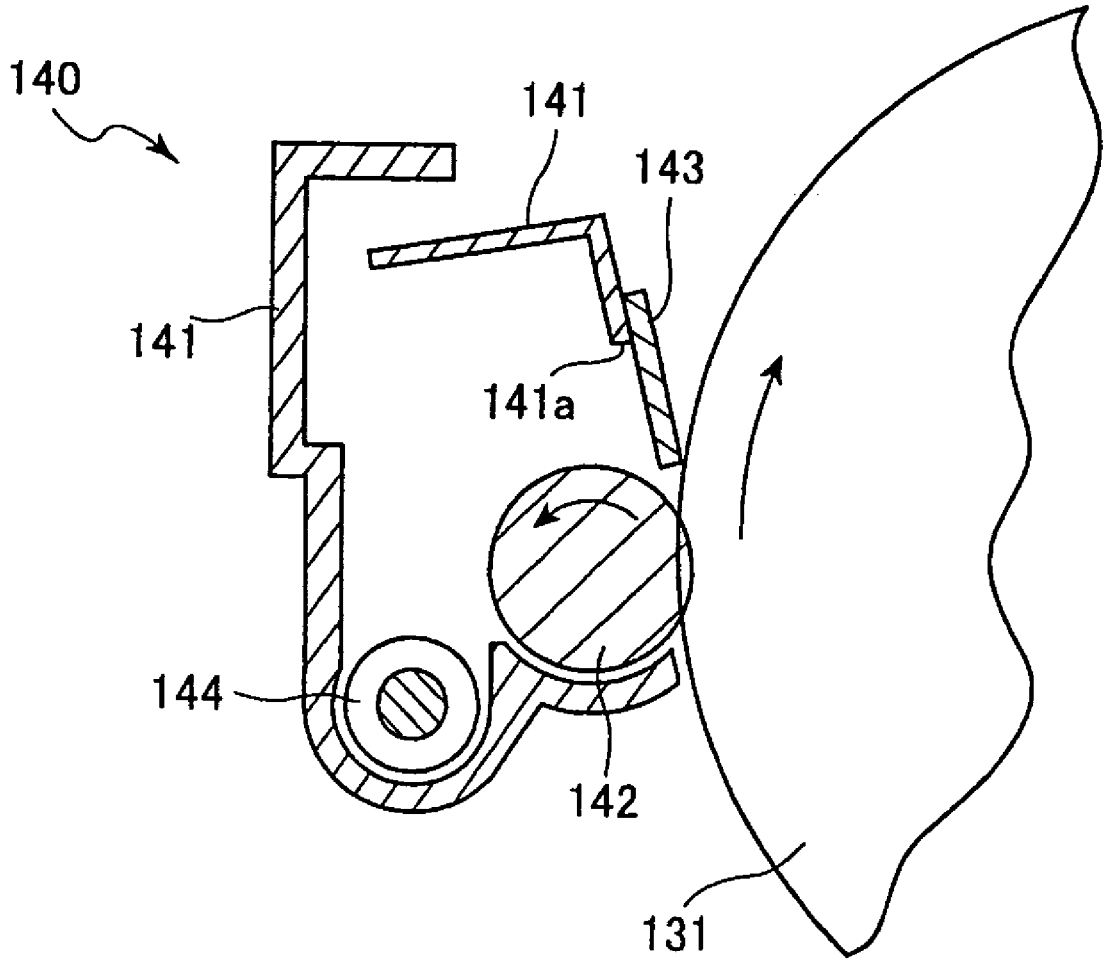
FIG.1 PRIOR ART
FIG. 1 is a cross-sectional view showing a conventional cleaning device.
Figure 2:
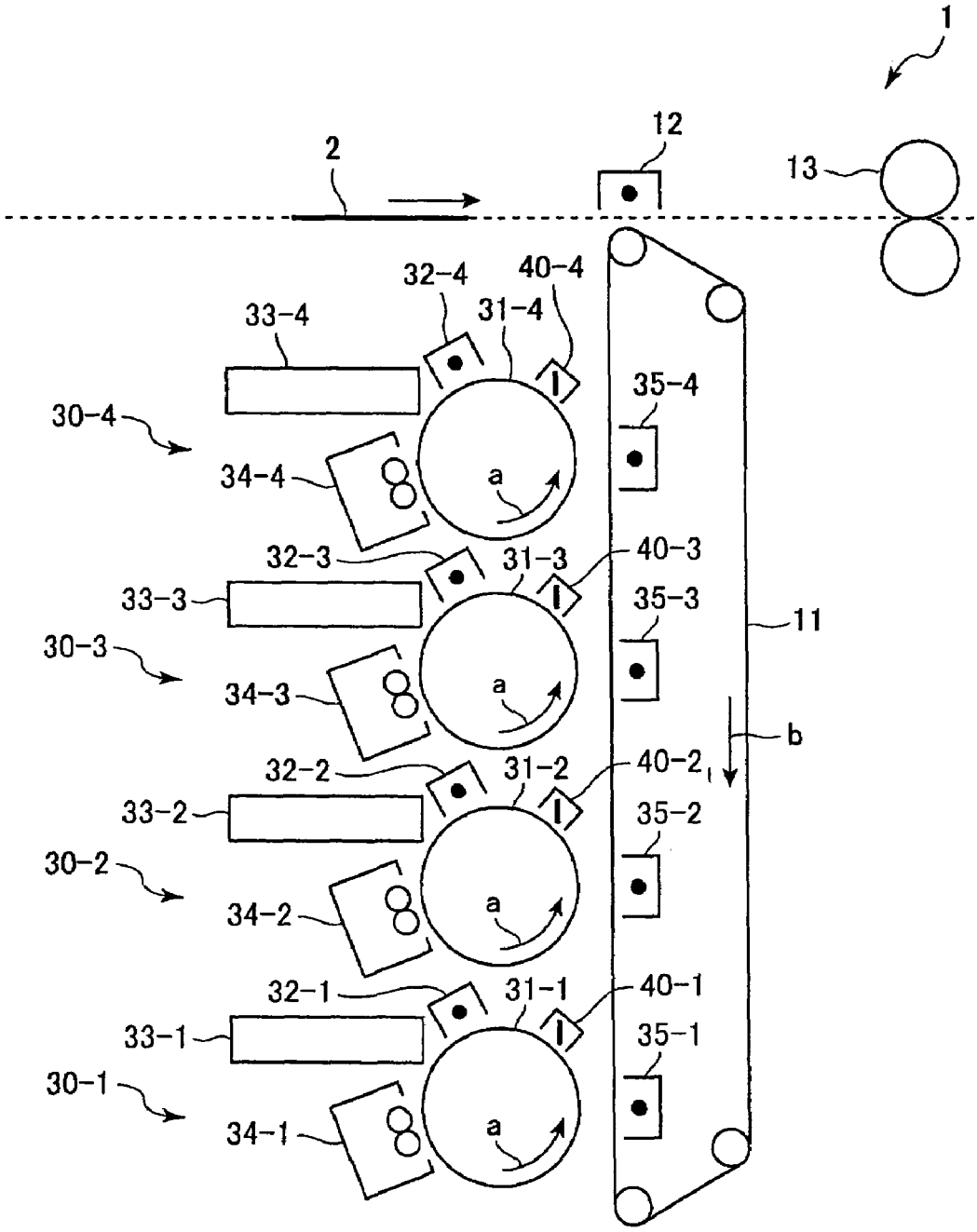
FIG. 2 is a schematic diagram showing an electrophotographic printer provided with a cleaning device according to a preferred embodiment of the present invention.

A cleaning device for an electrophotographic printer according to a preferred embodiment of the present invention will be described with reference to FIGS. 2 through 4C. The structure and operations of an electrophotographic printer in which the cleaning device is provided will be described. As shown in FIG. 2, an electrophotographic printer 1 is a full color laser printer that includes an intermediate transfer belt 11, a paper transfer unit 12, a fixing unit 13, and four printing units 30-1 through 30-4. The printing units 30-1 through 30-4 transfer toner images onto the intermediate transfer belt 11. The paper transfer unit 12 transfers the toner images from the intermediate transfer belt 11 onto a paper 2. The fixing unit 13 melts the toner images transferred onto the paper 2 to fix the images to the paper 2.

The four printing units 30-1 through 30-4 all have the same structure, but are assigned to different colors. Specifically, the printing unit 30-1 is assigned to yellow, the printing unit 30-2 to magenta, the printing unit 30-3 to cyan, and the printing unit 30-4 to black. The printing unit 30-1 includes a photosensitive drum 31-1, a charger 32-1, an exposing unit 33-1, a developer 34-1, a transfer unit 35-1, and a cleaning device 40-1. The charger 32-1 applies a high voltage to the surface of the photosensitive drum 31-1. The exposing unit 33-1 irradiates a laser as an on/off signal based on image data to form an electrostatic latent image on the photosensitive drum 31-1. The developer 34-1 develops the latent image to form a toner image on the photosensitive drum 31-1. The transfer unit 35-1 transfers this toner image onto the intermediate transfer belt 11. The cleaning device 40-1 removes toner remaining on the photosensitive drum 31-1 after the toner image has been transferred from the photosensitive drum 31-1 to the intermediate transfer belt 11. Each of these components is connected to and controlled by a controller (not shown). The remaining printing units 30-2 through 30-4 have the same structure as the printing unit 30-1. Hence, a detailed description of these printing units will not be provided.

During an image-forming process, the photosensitive drum 31-1 rotates in a direction indicated by an arrow a in FIG. 2 according to an image formation start command issued from the controller and continues to rotate until the image-forming process is completed. When the photosensitive drum 31-1 begins to rotate, the charger 32-1 applies a high voltage to the surface of the photosensitive drum 31-1, forming a uniform negative charge thereon.

The controller transfers a dot image generated from text and graphics data to the exposing unit 33-1 as an on/off signal for the exposing unit 33-1, and the exposing unit 33-1 irradiates laser light onto the surface of the photosensitive drum 31-1 based on this on/off signal. This process produces exposed areas that have been exposed to the laser light and have a reduced charge, and non-exposed areas on the surface of the photosensitive drum 31-1. When areas of the photosensitive drum 31-1 that were exposed to the laser light and have a reduced charge are rotated to a position opposite the developer 34-1, negatively charged toner is attracted to these areas of reduced charge, forming a toner image on the surface of the photosensitive drum 31-1.

When the toner image formed on the photosensitive drum 31-1 is rotated opposite the transfer unit 35-1, a high voltage applied by the transfer unit 35-1 causes the toner image to transfer onto the intermediate transfer belt 11, which is rotating in the direction indicated by an arrow b in FIG. 2. After passing this transfer position, the surface of the photosensitive drum 31-1 is cleaned by the cleaning device 40-1 to be ready for the next image-forming operation.

Subsequently, the printing unit 30-2 performs an image-forming operation similar to that performed by the printing unit 30-1. A toner image is formed on the photosensitive drum 31-2 and transferred to the intermediate transfer belt 11 by the effects of a high voltage applied by the transfer unit 35-2. By coordinating the timing at which the toner image formed in the printing unit 30-1 and transferred to the intermediate transfer belt 11 reaches the transfer unit 35-2 with the timing at which the toner image formed on the photosensitive drum 31-2 is transferred onto the intermediate transfer belt 11, the toner images formed in the printing unit 30-1 and printing unit 30-2 are superimposed on the intermediate transfer belt 11. Similarly, toner images formed in the printing unit 30-3 and printing unit 30-4 are superimposed on the toner images formed in the printing unit 30-1 and printing unit 30-2 when transferred onto the intermediate transfer belt 11, thereby forming a full color toner image on the surface of the intermediate transfer belt 11.

As the intermediate transfer belt 11 continues to rotate and convey the full color toner image to the paper transfer unit 12, a paper supply unit (not shown) provided in the printer 1 conveys the paper 2 so that the paper 2 arrives at the paper transfer unit 12 at the same time as the full color toner image. The high voltage applied by the paper transfer unit 12 causes the toner image to transfer onto the paper 2. The paper 2 is then conveyed to the fixing unit 13, and the fixing unit 13 fixes the toner image on the paper 2.

Figure 3:
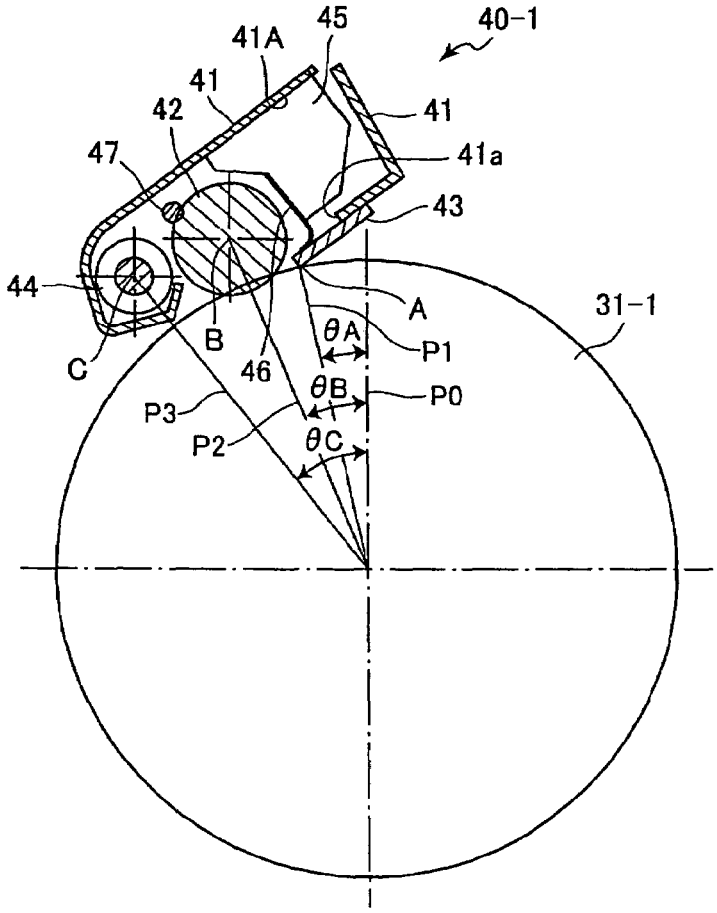
FIG. 3 is a cross-sectional view showing the relevant parts of the cleaning device according to the preferred embodiment.

Next, the structure and operations of the cleaning devices 40-1 through 40-4 will be described. As shown in FIG. 3, the cleaning devices 40-1 through 40-4 are disposed at positions vertically above the photosensitive drum 31-1 to achieve a compact printer 1. Since the cleaning devices 40-1 through 40-4 have the same structure, only the structure of the cleaning device 40-1 will be described herein while descriptions of the cleaning devices 40-2 through 40-4 are omitted.

As shown in FIGS. 2 through 3C, the cleaning device 40-1 includes a housing 41, a cleaning brush 42, a cleaning blade 43, and a screw 44. The cleaning brush 42 and screw 44 are housed in the housing 41, and the cleaning blade 43 is fixed to the outside of the housing 41. An opening 41*a* is formed in the housing 41 to allow communication between the inside and outside of the housing 41. The opening 41*a* is formed substantially in the bottom of the housing 41 opposing the photosensitive drum 31-1. The cleaning brush 42 and the cleaning blade 43 are disposed in the opening 41*a*. For the sake of description, the photosensitive drum 31-1, cleaning brush 42, and screw 44 are represented by circles in FIGS. 2 through 3C.

Figure 4A:
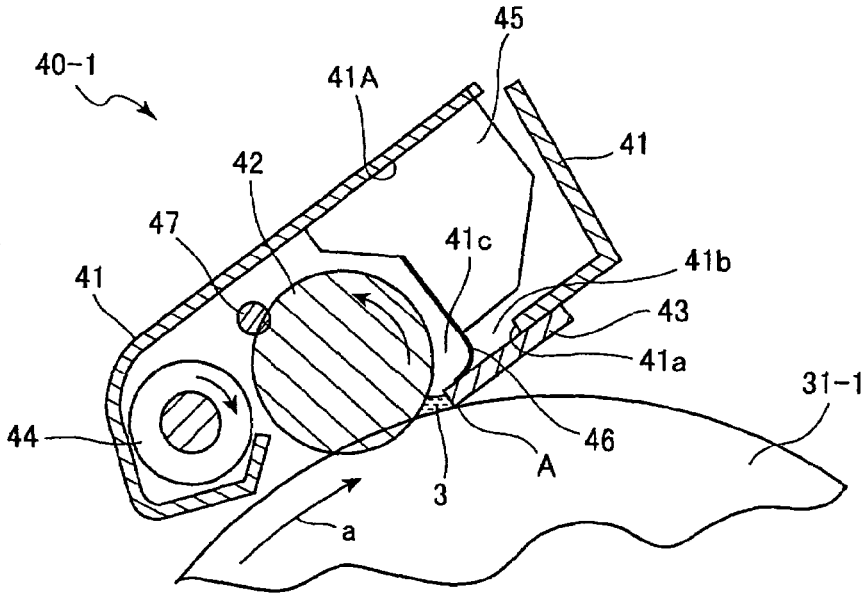
FIG. 4A are cross-sectional views illustrating how toner is removed from the surface of a photosensitive drum by the cleaning device of the preferred embodiment.

The cleaning blade 43 is substantially plate-shaped, with one end opposing and contacting the photosensitive drum 31-1. This end of the cleaning blade 43 is pressed against the surface of the photosensitive drum 31-1 by the urging force of a spring (not shown) to form a contact line A. The other end of the cleaning blade 43 is fixed to outside of the housing 41. As shown in FIG. 4A through 3C, a tangent to the photosensitive drum 31-1 at the contact line A that extends downstream in the rotational direction a of the photosensitive drum 31-1 forms an acute angle with the cleaning blade 43.

The cleaning blade 43 is formed of polyurethane rubber that has a resilience of H, where $30\% \leqq H \leqq 50\%$ (JIS K6301: measured at 25° C. and 50% humidity). If the H is less than 30%, more toner 3 will likely pass under the cleaning blade 43. If the H exceeds 50%, the cleaning blade 43 has a tendency to curl or become chipped, reducing reliability of the cleaning ability of the cleaning blade 43.

Further, the cleaning blade 43 has a permanent elongation of E such that $0\% \leqq E \leqq 1.3\%$ (JIS K6301: measured at 25° C. and 50% humidity). If E exceeds 1.3%, the resilience of the rubber in the cleaning blade 43 will deteriorate, enabling the toner 3 to pass under the cleaning blade 43 and reducing reliability of the cleaning ability of the cleaning blade 43.

Further, the rubber of the cleaning blade 43 has a hardness K such that 67≦K≦73 (JIS K6301: measured at 25° C. and 50% humidity). If K is less than 67, then the toner 3 is more likely to pass under the cleaning blade 43. If the K is greater than 73, then the cleaning blade 43 is likely to curl or chip, reducing reliability of the cleaning ability of the cleaning blade 43.

The cleaning brush 42 is substantially cylindrical in shape and is disposed in contact with the photosensitive drum 31-1 at a position upstream of the cleaning blade 43 with respect to the rotational direction of the photosensitive drum 31-1. The rotational axis of the cleaning brush 42 is substantially parallel to the rotational axis of the photosensitive drum 31-1. As shown in FIG. 4A, the cleaning brush 42 is configured to rotate counterclockwise when the photosensitive drum 31-1 rotates in the clockwise direction. After the cleaning blade 43 scrapes the toner 3 remaining on the surface of the photosensitive drum 31-1 after the toner image has been transferred to the intermediate transfer belt 11, the cleaning brush 42 removes the scraped toner 3 from the surface of the photosensitive drum 31-1.

As shown in FIGS. 2 through 3C, an auxiliary toner conveying part 45 is disposed inside the housing 41 and is fixed to an inner surface 41A of the housing 41 that opposes the housing opening 41*a*. As shown in FIG. 4A, the auxiliary toner conveying part 45 is disposed in opposition to the surface of the cleaning brush 42 from the topmost position of the cleaning brush 42 to a position about one quarter around the outer circumference of the cleaning brush 42 upstream with respect to the rotational direction of the cleaning brush 42. The lower edge of the auxiliary toner conveying part 45 is separated from the cleaning blade 43 forming a gap 41*b* therebetween.

A sheet-like resilient member 46 is disposed on the bottom side of the auxiliary toner conveying part 45 opposing the cleaning brush 42. One end of the resilient member 46 is fixed to the bottom surface of the auxiliary toner conveying part 45 opposing the cleaning brush 42, while the other end is fixed to the portion of the cleaning blade 43 that forms the contact line A.

A gap 41*c* of 1-3 mm is formed between the auxiliary toner conveying part 45 and resilient member 46, and the peripheral surface of the cleaning brush 42.

The surfaces of the auxiliary toner conveying part 45 and resilient member 46 opposing the cleaning brush 42 have a roughness RZ such that RZ≦12μ. If RZ exceeds 12μ, toner clogging and other problems suddenly occur.

A flicker bar 47 is disposed in the housing 41 for knocking off the toner 3 deposited on the cleaning brush 42. The flicker bar 47 is disposed in contact with the peripheral surface of the cleaning brush 42 between the auxiliary toner conveying part 45 and the screw 44. The scraping depth between the flicker bar 47 and cleaning brush 42 is 0.5-1.5 mm.

The screw 44 is substantially cylindrical in shape and is disposed at a position downstream of the flicker bar 47 with respect to the rotational direction of the cleaning brush 42 and opposing both the cleaning brush 42 and flicker bar 47. The rotational axis of the screw 44 is substantially parallel to the rotational axis of the photosensitive drum 31-1. Surface portions of the screw 44 other than the portions opposing the flicker bar 47 and cleaning brush 42 are closely surrounded by the housing 41. By rotating, the screw 44 conveys toner 3 knocked off of the cleaning brush 42 by the flicker bar 47 along the axial direction of the screw 44.

Next, the positional relationships of the photosensitive drum 31-1, cleaning brush 42, and screw 44 will be described with reference to FIG. 3. In this description, an upward vertical imaginary plane P0 from the rotational axis of the photosensitive drum 31-1 is at an angle of 0°, while planes from the rotational axis of the photosensitive drum 31-1 farther upstream in the rotational direction of the photosensitive drum 31-1, that is, in the counterclockwise direction of FIG. 3, form positive angles with the vertical imaginary plane P0. Hence, a first imaginary plane P1 connecting the rotational axis of the photosensitive drum 31-1 to the contact line A forms an angle θA of 30° or less with the vertical imaginary plane P0. Forming the angle θA greater than 30° will cause problems in constructing the printer 1 of FIG. 2.

Further, a second imaginary plane P2 connecting the rotational axis of the photosensitive drum 31-1 to the rotational axis B of the cleaning brush 42 forms an angle θB with the vertical imaginary plane P0 such that $|\theta A-\theta B|<10°$. Setting the $|\theta A-\theta B|\geqq 10°$ will cause problems in constructing the printer 1 of FIG. 2. Further, a third imaginary plane P3 connecting the rotational axis of the photosensitive drum 31-1 with the rotational axis C of the screw 44 forms an angle θC with the vertical imaginary plane P0 such that $10°<|\theta A-\theta C|<30°$. Setting $|\theta A-\theta C|$ less than or equal to 10° or greater than or equal to 30° will cause problems in constructing the printer 1 of FIG. 2.

During an image-forming operation, the toner 3 is conveyed in the cleaning device 40-1 according to the following process. First, the cleaning blade 43 scrapes the toner 3 from the surface of the photosensitive drum 31-1. The toner 3 accumulates between the cleaning blade 43 and cleaning brush 42, as shown in FIG. 4A. The amount of accumulated toner 3 gradually increases, but the space for accumulating toner 3 is restricted between the cleaning brush 42 and the auxiliary toner conveying part 45 and resilient member 46.

Figure 4B:
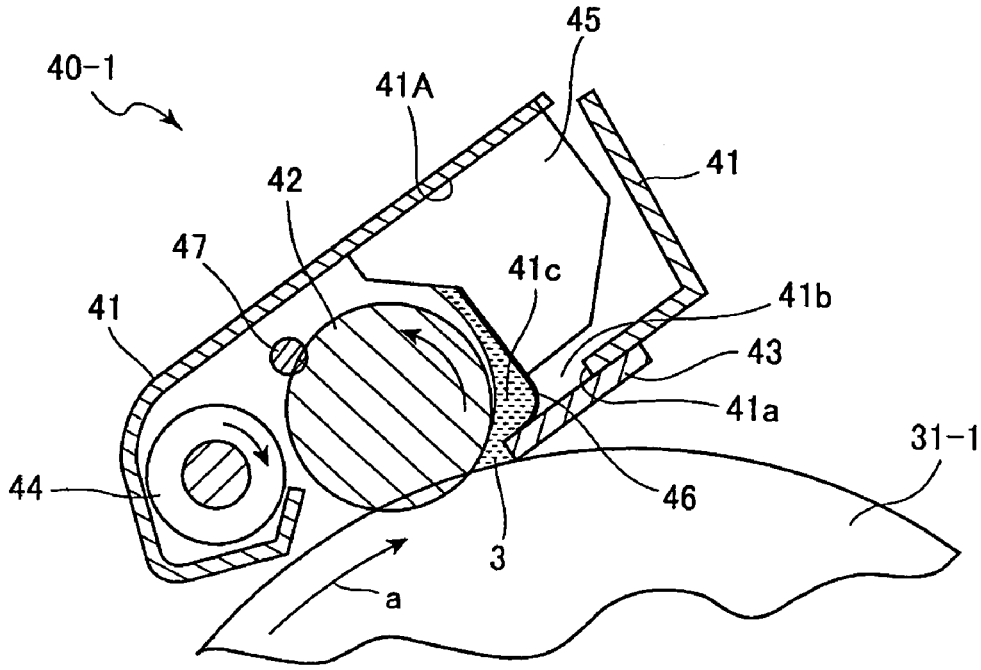
FIG. 4B are cross-sectional views illustrating how toner is removed from the surface of a photosensitive drum by the cleaning device of the preferred embodiment.
Figure 4C:
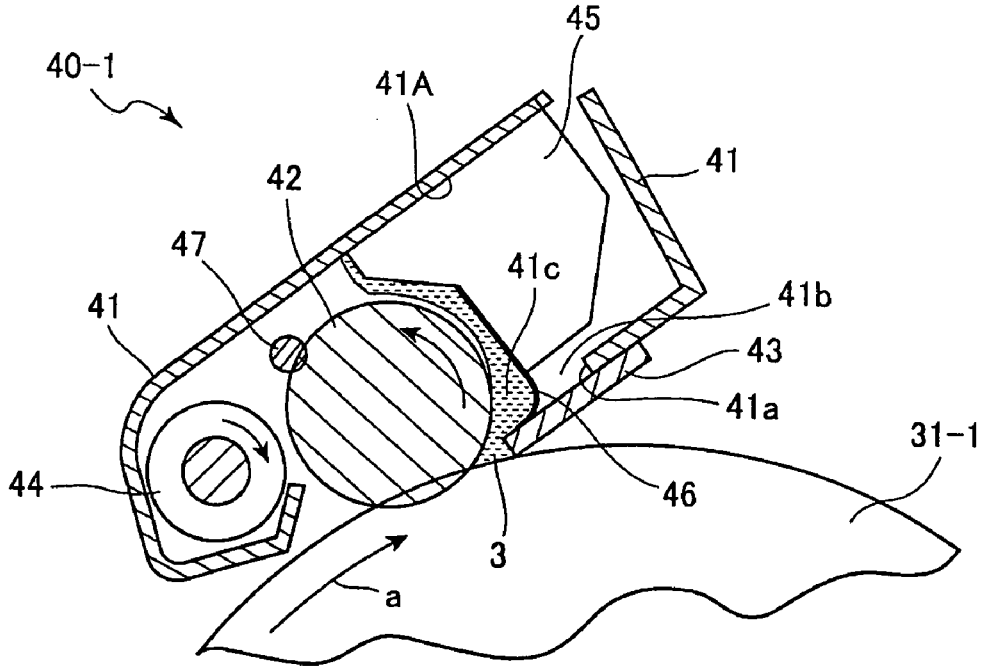
FIG. 4C are cross-sectional views illustrating how toner is removed from the surface of a photosensitive drum by the cleaning device of the preferred embodiment.

As shown in FIG. 4B, the accumulated toner 3 is conveyed toward the top of the cleaning brush 42 along the resilient member 46 and auxiliary toner conveying part 45 by the rotations of the cleaning brush 42. When the accumulated toner 3 reaches a position near the top of the cleaning brush 42, as shown in FIG. 4C, the accumulated toner 3 falls onto the cleaning brush 42 and is conveyed toward the screw 44 by the rotation of the cleaning brush 42. The screw 44 discharges the toner 3 from the cleaning device 40-1.

As described above, since the resilient member 46 fills the gap 41*b* formed between the bottom edge of the auxiliary toner conveying part 45 and the cleaning blade 43, the toner 3 preventing from entering the gap 41*b*. Hence, even if the cleaning blade 43 vibrates when cleaning the photosensitive drum 31-1, the resilient member 46 can expand and contract in response to the movement of the cleaning blade 43 in order to prevent the toner 3 from entering the gap 41*b*.

As described above, the gap 41*c* of 1-3 mm is formed between the auxiliary toner conveying part 45 and resilient member 46, and the peripheral surface of the cleaning brush 42. If the gap 41*c* is less than 1 mm, the toner 3 may become clogged therein and not be conveyed. Further, if the toner 3 accumulates between the cleaning blade 43 and cleaning brush 42 and cannot be conveyed upward, some of the toner 3 will pass between the cleaning blade 43 and photosensitive drum 31-1.

If the gap 41*c* is greater than 3 mm, the amount of uncirculated toner among the toner 3 accumulating between the cleaning blade 43 and cleaning brush 42 will increase and form a lump over time. When this toner lump is eventually conveyed by the cleaning brush 42, the lump may stop at a flicker bar 47 described later, resulting in toner conveying problems, or may become packed around the screw 44, resulting in other problems.

When the gap 41*c* is set within this range, the printer 1 configured with the housing 41 disposed above the photosensitive drum 31-1 can remove the toner 3 from the photosensitive drum 31-1 and accumulate the toner 3 in the gap 41*c* that extends substantially vertically and can convey the toner 3 against gravity along the same direction. Accordingly, the toner 3 does not incur a large load when accumulated. If the toner 3 were to incur a large load, the toner 3 would become compressed and hardened and it would not be possible to convey the toner 3 upward against gravity. As a result, the toner 3 would become clogged and subsequent toner 3 removed from the photosensitive drum 31-1 would have no place to go and would therefore pass beneath the cleaning blade 43 and photosensitive drum 31-1. However, since the toner 3 does not incur a large load in the preferred embodiment, the printer 1 of the preferred embodiment prevents toner 3 from becoming clogged, thereby preventing toner from spilling out and scattering.

As described above, by setting RZ less than or equal to 12μ, the preferred embodiment effectively prevents toner 3 from clogging in the gap 41*c* between the cleaning brush 42 and the auxiliary toner conveying part 45, and resilient member 46.

As described above, the scraping depth between the flicker bar 47 and cleaning brush 42 is 0.5-1.5 mm. If the scraping depth is less than 0.5 mm, the flicker bar 47 cannot sufficiently knock off toner 3 that has accumulated on the cleaning brush 42. If the scraping depth exceeds 1.5 mm, the cleaning brush 42 is closer to the flicker bar 47 than necessary, causing fall over the bristles of the cleaning brush 42. By setting the scraping depth within this range, the flicker bar 47 can effectively knock off the toner 3 of the cleaning brush 42 at a position separated from the gap 41*c*.

In addition to positioning the photosensitive drum 31-1, cleaning brush 42, and screw 44 with the above relationship, the gap 41*c* formed between the peripheral surface of the cleaning brush 42 and the auxiliary toner conveying part 45 and resilient member 46 is set to 1-3 mm. Accordingly, toner 3 can be conveyed appropriately while the overall printer 1 is constructed in compact dimensions, while preventing toner 3 from becoming clogged in the gap 41*c*, thereby reliably cleaning toner 3 from the photosensitive drum 31-1 and preventing toner 3 from spilling out or scattering. As a result, a compact printer 1 can prevent problems in cleaning or conveying toner 3 from occurring without a complex construction.

An experiment for confirming the effects of the preferred embodiment was conducted. This experiment employed the printer 1 and the cleaning device 40-1 of the preferred embodiment, where the photosensitive drum 31-1 had a diameter of 100 mm and was coated with OPC. For comparison, experiments were also performed on an electrophotographic printer and cleaning device with components having characteristics and dimensions outside the ranges specified in the preferred embodiment. In addition, the photosensitive drum 31-1 was rotated at a speed of 400 mm/s and a common two-component toner formed of a ground polyester was used as the toner 3.

Through these experiments, it was found that the toner 3 was properly conveyed when the gap 41*c* between the peripheral surface of the cleaning brush 42 and the auxiliary toner conveying part 45 and resilient member 46 was set to 1-3 mm according to the preferred embodiment. However, when the gap 41*c* was less than 1 mm, the toner 3 became clogged between the cleaning brush 42 and the auxiliary toner conveying part 45 and resilient member 46 and could not be conveyed. Since subsequent toner had no place to accumulate after the toner 3 became clogged, this toner slipped between the cleaning blade 43 and the photosensitive drum 31-1.

On the other hand, when the gap 41*c* exceeded 3 mm, the amount of unconveyed toner 3 accumulating between the cleaning blade 43 and cleaning brush 42 increased. After some time, this toner 3 formed in a large lump that was eventually conveyed by the cleaning brush 42. Such lumps of toner 3 stopped at the flicker bar 47, preventing other toner from being conveyed, or became clogged in the screw 44.

It was also confirmed that the toner 3 could be conveyed appropriately when the angle θA was set no more than 30°. However, when the angle θA was set outside of this range, the toner 3 became clogged between the cleaning brush 42 and the auxiliary toner conveying part 45 and resilient member 46, generating problems in conveying the toner 3.

It was also confirmed that the toner 3 could be conveyed properly when the angles θB and θA were set such that $|\theta A-\theta B|<10°$. However, it was found that the toner 3 could not be cleaned reliably when the angles θB and θA did not satisfy this expression.

It was also confirmed that the toner 3 could be conveyed properly when the angles θC and θA were set such that $10°<|\theta A-\theta C|<30°$. However, it was found that the toner 3 could not be cleaned reliably when the angles θC and θA did not satisfy this expression.

It was also confirmed that the flicker bar 47 could efficiently knock off the toner 3 carried on the cleaning brush 42 and effectively prevent the toner 3 from remaining clogged in the cleaning brush 42 when the scraping depth between the flicker bar 47 and cleaning brush 42 was set to 0.5-1.5 mm. However, when the scraping depth was set outside of this range, the flicker bar 47 could not efficiently knock off the toner 3 from the cleaning brush 42, resulting in toner remaining in the cleaning brush 42.

When the resilience H of the cleaning blade 43 was set such that $30\% \leqq H \leqq 50\%$, it was found that the cleaning blade 43 could perform reliable cleaning for up to 400,000 sheets without generating problems such as curling of the cleaning blade 43 or other cleaning problems occurring. However, when the resilience H was set outside of this range, curling in the cleaning blade 43 and other cleaning problems were found to occur at about 300,000 sheets.

Further, when the permanent elongation E of the cleaning blade 43 is such that $0\%<E \leqq 1.3\%$, it was confirmed that the cleaning blade 43 could reliably clean toner up to 400,000 sheets without curling of the cleaning blade 43 or other cleaning problems occurring. However, if the permanent elongation E was outside of this range, it was found that curling of the cleaning blade 43 and other cleaning problems occurred at about 300,000 sheets.

When the rubber hardness K of the cleaning blade 43 was set such that $67 \leqq K \leqq 73$, it was confirmed that the cleaning blade 43 could clean toner reliably up to 400,000 sheets without curling of the cleaning blade 43 or other cleaning problems occurring. However, if the hardness K was outside of this range, curling of the cleaning blade 43 and other curling problems were found to occur at about 300,000 sheets.

Further, it was found that setting the surface roughness RZ of the auxiliary toner conveying part 45 and resilient member 46 less than or equal to 12μ was effective in preventing toner from clogging in the gap 41*c*. However, toner clogging abruptly occurred when the surface roughness RZ was set outside of this range.

Further, it was found that the cleaning device 40-1 having this construction was able to maintain the toner 3 in the gap 41C between the cleaning brush 42 and the auxiliary toner conveying part 45 and resilient member 46 when removing the cleaning device 40-1 for maintenance or the like. Hence, the cleaning device 40-1 of the preferred embodiment greatly reduced the problem of toner 3 falling out of the cleaning device 40-1.

Figure 5:
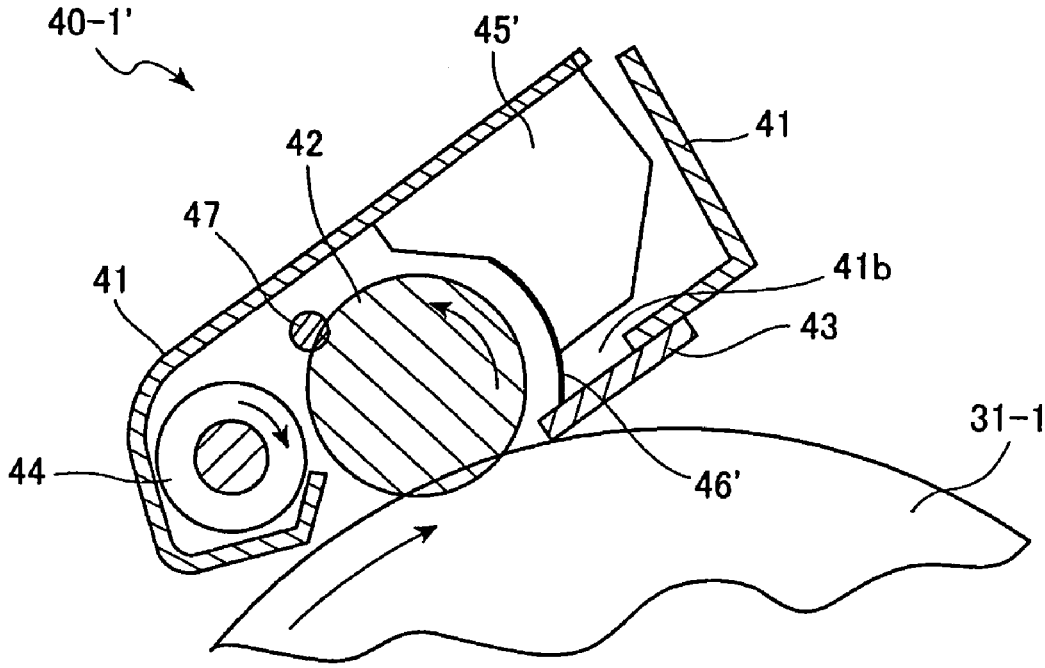
FIG. 5 is a cross-sectional view showing the relevant parts of a cleaning device according to a variation of the preferred embodiment.

While the invention has been described in detail with reference to specific embodiments thereof, it would be apparent to those skilled in the art that many modifications and variations may be made therein without departing from the spirit of the invention, the scope of which is defined by the attached claims. For example, in a cleaning device 40-1' shown in FIG. 5, surfaces of an auxiliary toner conveying part 45' and a resilient member 46' opposing the cleaning brush 42 form an arc centered on the rotational axis of the cleaning brush 42. With this construction, the toner 3 removed from the photosensitive drum 31-1 accumulates in the gap 41*c* in a substantially vertical direction that follows the arc-shaped surface of the auxiliary toner conveying part 45' and resilient member 46', enabling the toner 3 to be conveyed smoothly in the same direction.

What is claimed is:

1. An image forming apparatus comprising:

an image-carrying member rotatable in a direction about a rotational axis;

a cleaning blade having a peripheral surface and disposed in contact with an image-carrying member;

a cleaning brush disposed in contact with the image-carrying member at a position upstream of the cleaning blade with respect to the rotational direction of the image-carrying member;

a housing disposed substantially vertically above the image-carrying member for accommodating the cleaning blade and the cleaning brush and having a toner flow path for leading toner from the cleaning blade to a position substantially vertically above the cleaning brush substantially along the peripheral surface of the cleaning brush; and an auxiliary toner conveying member disposed on the side of the cleaning brush, a predetermined gap being formed between the auxiliary toner conveying member and the cleaning brush, wherein the toner flow path is formed between the auxiliary toner conveying member and the peripheral surface of the cleaning brush.

2. The image forming apparatus according to claim 1, wherein the gap of 1-3 mm is formed between the auxiliary toner conveying member and the peripheral surface of the cleaning brush.

3. The image forming apparatus according to claim 1, further comprising a flicker bar disposed in contact with the cleaning brush at a position downstream of a part of the cleaning brush opposing the auxiliary toner conveying member with respect to the rotational direction of the cleaning brush for knocking off toner deposited on the cleaning brush, such that the flicker bar contacts the cleaning brush with a scraping depth of 0.5-1.5 mm.

4. The image forming apparatus according to claim 1, wherein the cleaning blade has a free end that contacts the image-carrying member at a contact line; and a first imaginary plane connecting the rotational axis of the image-carrying member to the contact line forms an angle θ A of 30° or less with an imaginary vertical plane extending vertically upward from the rotational axis of the image-carrying member.

5. The image forming apparatus according to claim 4, a second imaginary plane connecting the rotational axis of the image-carrying member to a rotational axis of the cleaning brush forms an angle θ B with an imaginary vertical plane extending vertically upward from the rotational axis of the image-carrying member such that $|\theta A-\theta B|<10°$.

6. The image forming apparatus according to claim 4, further comprising a screw provided in opposition to the cleaning brush on the downstream end with respect to the rotational direction of the image-carrying member;

wherein the screw rotates about an axis parallel to the rotational axis of the image-carrying member, a third imaginary plane connecting the rotational axis of the image-carrying member to the rotational axis of the screw forms an angle θ C with an imaginary vertical plane extending vertically upward from the rotational axis of the image-carrying member such that $10°<|\theta A-\theta C|<30°$

7. The image forming apparatus according to claim 1, wherein the cleaning blade has a resilience H such that 30%<H<50% (JIS K6301: measured at 25° C. and 50% humidity).

8. The image forming apparatus according to claim 1, wherein the cleaning blade has a permanent elongation E such that $0\%<E\leqq 1.3\%$ (JIS K6301: measured at 25° C. and 50% humidity).

9. The image forming apparatus according to claim 1, wherein the cleaning blade is formed of at least polyurethane rubber having a rubber hardness K such that $67\leqq K\leqq 73$(JIS K6301: measured at 25° C. and 50% humidity).

10. The image forming apparatus according to claim 1, wherein the auxiliary toner conveying member has an arc-shaped surface centered on the rotational axis of the cleaning brush.

11. The image forming apparatus according to claim 1, wherein a surface of the auxiliary toner conveying member opposing the cleaning brush has a roughness RZ such that $RZ\leqq 12\mu$.

* * * * *